US005090486A

United States Patent [19]

Jones

[11] Patent Number: 5,090,486

[45] Date of Patent: Feb. 25, 1992

[54] MULTI-PURPOSE EARTH DRILL

[76] Inventor: Clyde S. Jones, 2109 N. Penelope, Belton, Tex. 76513

[21] Appl. No.: 531,082

[22] Filed: May 31, 1990

[51] Int. Cl.[5] ..... E21B 3/02

[52] U.S. Cl. ..... 173/26; 173/28; 173/140; 175/162; 175/203

[58] Field of Search ..... 173/22, 26, 28, 24, 173/23, 25, 27, 140; 175/162, 171, 203, 220

[56] References Cited

U.S. PATENT DOCUMENTS

| | | | |
|---|---|---|---|
| 2,239,024 | 4/1941 | Vance | 175/162 |
| 2,639,892 | 5/1953 | Jones | 173/26 X |
| 2,662,736 | 12/1953 | Abrams | 173/26 X |
| 2,774,568 | 12/1956 | Jones | 173/140 |
| 2,894,723 | 7/1959 | Gustafson | 173/28 X |
| 2,939,682 | 6/1960 | Kromberg | 173/37 X |
| 3,700,045 | 10/1972 | Coontz | 173/26 |
| 3,756,330 | 9/1973 | Russell, Jr. | 173/23 X |
| 4,336,840 | 6/1982 | Bailey | 173/28 X |

*Primary Examiner*—Hien H. Phan
*Assistant Examiner*—Raymond D. Woods
*Attorney, Agent, or Firm*—Joseph F. Long

[57] ABSTRACT

The multipurpose earth drill is tractor mountable with hydraulic operators to allow using the weight of the tractor for downward pressure on an extensible shaft earth drill which may be an auger or rack bit, the drill being rotated using an extensible shaft from the power take-off of the tractor and moved upward and downward with a pair of hydraulic operators that allow minimizing the overall height of the unit. The auger and auger drive gears are completely enclosed for personnel safety.

8 Claims, 3 Drawing Sheets

MULTI-PURPOSE EARTH DRILL

BACKGROUND OF THE INVENTION

This invention is similar to the normal tractor mounted post hole digger but differs in several commercially important aspects. The earth drill of this invention will drill post holes but also is designed with a low profile to drill holes in an area with restricted headroom. Further, the design incorporates an extensible auger that allows drilling holes to greater than six foot depths. Special drills equipped with rock bits are also used in this design since locking features to allow using the tractor weight to put downward pressure on the drill are included. Most importantly all moving parts are guarded and the unit is equipped with an automatic overload trip to not only improve personnel safety but also to allow drilling holes directly under a somewhat moveable obstruction such as a fence by using the auger guard to hold the obstruction temporarily out of the way.

The low profile is obtained using two commercially available hydraulic cylinders fastened side by side and moveable within a channel in the unit housing to pressure the auger downward and to lift the auger out of a hole.

We have considered the following patents:

| Document No. | Name | Date |
|---|---|---|
| 3,700,045 | John G. Coontz | 10/24/72 |
| 2,939,682 | Paul J. Kromberg | 01/08/58 |
| 2,662,736 | W. A. Abrams | 02/19/52 |
| 2,639,892 | Glenn H. Jones | 05/26/53 |
| 2,774,568 | Glenn H. Jones | 12/18/56 |

SUMMARY OF THE INVENTION

An extensible shaft auger or bit is mounted to an auger drive yoke moveable vertically in a heavy duty steel housing. The housing has mounting arms to mount to a three point hitch on a tractor. Drive gears with an automatic torque limiter cooperate with an extensible shaft from the power take-off of the tractor in order to rotate the auger as the auger is moved vertically.

In order to minimize the overall height of the unit to allow use in low clearance areas, the yoke is moved vertically with a minimum of two commercially available double acting hydraulic cylinders rigidly fastened together side by side and moveable in a channel in the housing. With the arrangement with the hydraulic cylinders approximately two feet long the yoke may move vertically almost four feet with two hydraulic cylinders fastened together and to the auger drive yoke. The first of the cylinders may operate to push both downward along with the drive yoke and when the first is fully extended the second operates to push the auger drive yoke further downward. The operation may be reversed to pull the auger drive yoke upward. The mounting arms from the heavy duty steel housing extend to allow mounting the housing approximately three feet behind the connections of the mounting arms to the three point hitch of the tractor.

The three point hitch of the tractor is modified to include an extensible locking arm to lock the three point hitch to allow using the weight of the tractor to push downward on the drill as the dual double acting hydraulic cylinders force the auger drive yoke downward.

An upper member of the three point hitch is modified to be lengthened or shortened with a hydraulic cylinder. This upper member and the extensible locking arm form a triangle with a vertical member of the housing mounting arms and may be adjusted to put the auger in a vertical position. This hydraulic cylinder in the upper member of the three point hitch may be also used to tilt the housing in cooperation with the three point hitch hydraulic lift in order to secure road clearance for transport while the unit is attached to the tractor. Both may also be adjusted to put downward pressure on the housing to prevent some housing movement when a rock bit is first engaged with rock, on or very near the surface of the land. The auger itself and the auger drive gear are enclosed for personnel safety and utility.

DETAILED DESCRIPTION OF THE INVENTION

The invention in a preferred embodiment may best be described by reference to the drawings.

Figure 1:
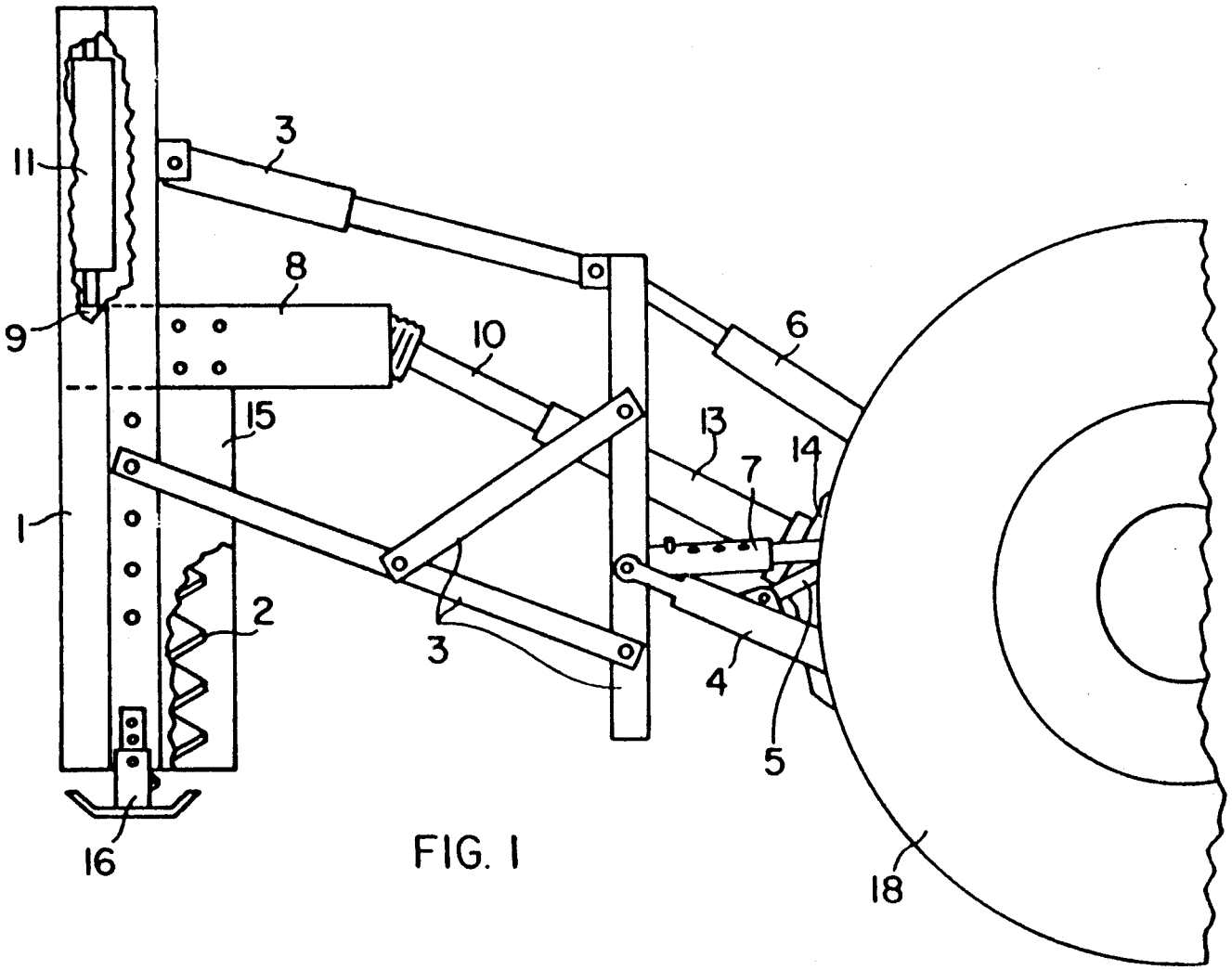
FIG. 1 shows a side view of the invention mounted to a three point hitch on a tractor.

In FIG. 1 we show a side view of the multipurpose earth drill mounted to a tractor differential case 14. The heavy steel housing 1 has a pair of extensible feet 16 to allow firm vertical positioning in use. The housing 1 is shaped with channels to guide auger drive yoke 9 and to guide a pair of double acting hydraulic cylinders 11 connected at an upper extensible end of one cylinder to housing and at a lower extensible end of the other cylinder to drive yoke 9 to move auger 2 vertically. Auger 2, in a preferred embodiment, has a square extensible shaft 21, FIG. 3 and is driven by extensible rotating shaft 10 from the gear drive mechanism 8. At times the auger or rock bit will catch on a root or rock and the automatic reset torque limiter in the gear drive mechanism 8 trips to disengage the gears in the gear drive mechanism. The auger may be disengaged and the gears will automatically reset when the power take-off speed is reduced. The mounting arms 3 comprise a U shaped vertical member held parallel to the housing 1 with a single member attached to the top of housing 1 and a member on each side of the U shaped vertical member and braced thereto connected on each side of housing 1 to form a strong connection to housing 1.

The U shaped vertical member of mounting arms 3 is connected one either side at the lower ends to the lower member of the three point hitch 4 with the upper member of the three point hitch 4 connecting to the center of the U shaped mounting arm member. The other ends of the three point hitch 4 connect to the tractor differential case 14. An extensible locking arm 7 connected at one end between hitch arms 4 and mounting arms 3 and at the other end to the tractor differential case 14 may be conveniently made of a shaft within a shaft with matching holes to allow pinning the bar or arm to be different effective lengths. When a pin is inserted this prevents the three point hitch 4 from having its normal floating action and in turn causes downward force on auger 2 by dual double acting hydraulic cylinders 11 to be directly transferred to upward force tending to raise tractor 18 when the tip end of auger 2 engages the earth to drill a hole.

A hydraulic cylinder operator 6 in an upper member of modified three point hitch 4 allows adjusting the effective length of this member to level or tilt housing 1 and to hold the housing 1 firmly in place as auger 2 enters the ground.

Figure 2:
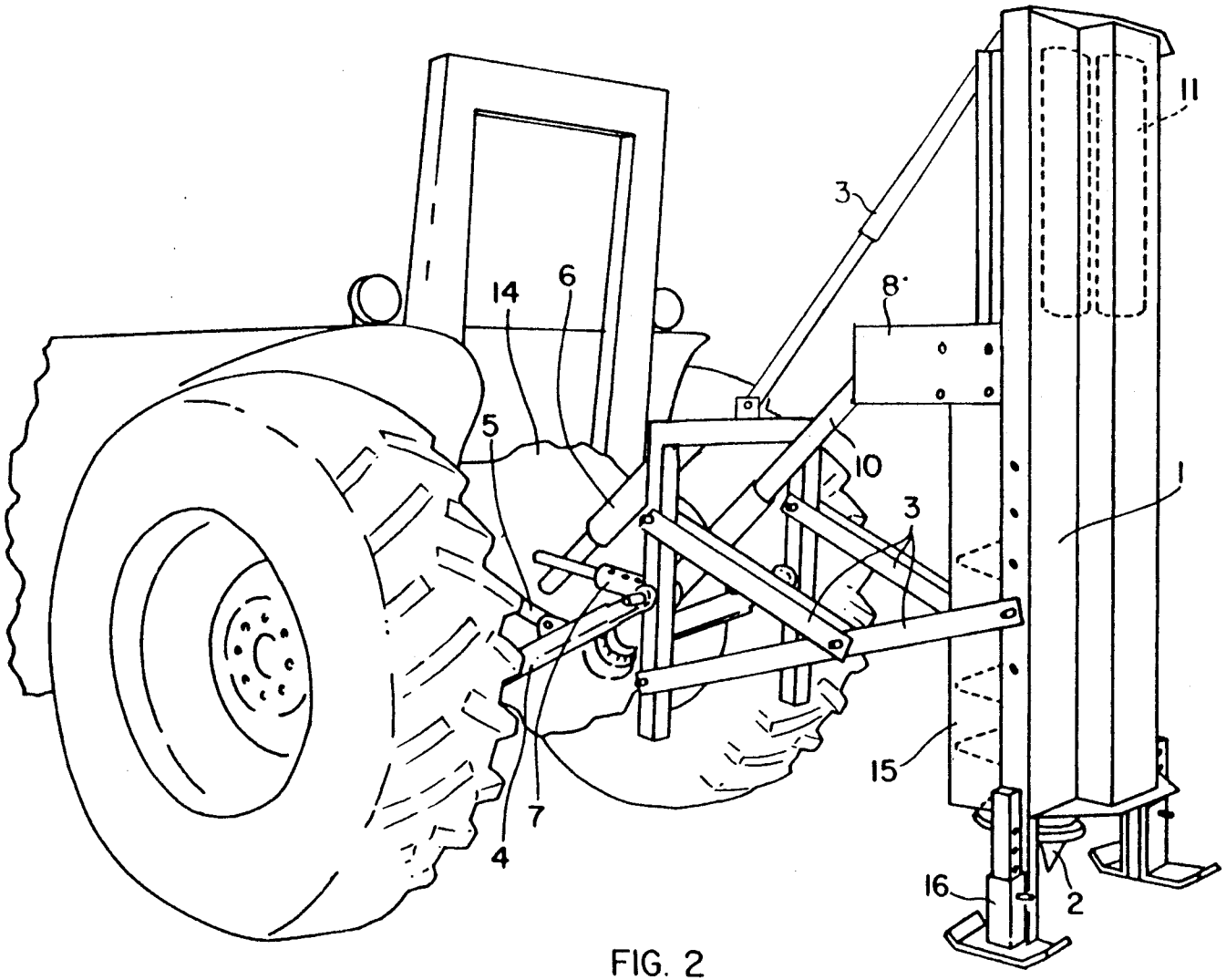
FIG. 2 shows perspective view indicating more details of the mounting arms.

FIG. 2 shows a perspective view of the invention indicating attachment of extensible locking arm 7 and hydraulic operator 6 to tractor differential case 14.

Figure 3:
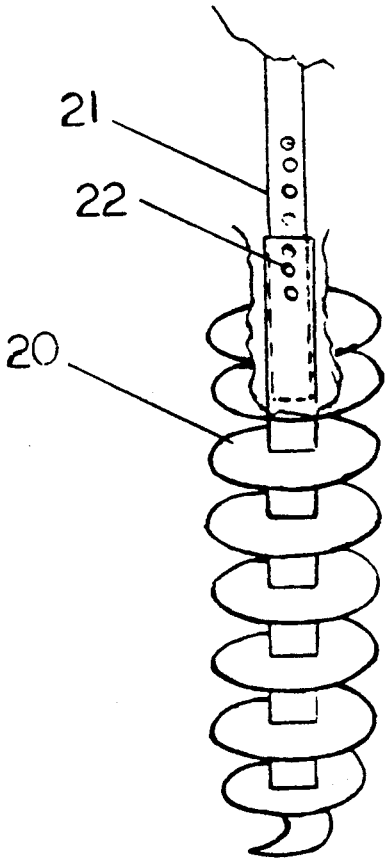
FIG. 3 shows a view of the auger.

FIG. 3 shows auger 2 with flights 20 mounted on the outer member of the hollow square cross section extensible shaft 21 with pin 22 to adjust the effective length of shaft 21 by pinning an inner square cross section member to the outer member.

FIG. 1

1=housing
2=auger
3=mounting arms
4=three point hitch
5=three point hitch hydraulic lift
6=hydraulic operator
7=extensible locking arm or bar
8=gear drive mechanism with automatic reset torque limiter
9=auger drive yoke
10=extensible drive shaft
11=dual double acting hydraulic cylinder
13=power take-off
14=tractor differential case
15=guard for auger
16=extensible feet
18=tractor

FIG. 2

1=housing
2=auger
3=mounting arms
4=three point hitch
6=hydraulic operator
8=gear drive mechanism with automatic reset torque limiter
10=extensible drive shaft
15=auger guard
16=extensible feet

FIG. 3

2=auger
20=flight of auger
21=extensible square cross section shaft
22=length adjustment pin

What is claimed is:

1. A tractor mounted earth drill comprising:

(a) a rigid channel shaped housing with mounting arms;

(b) an extensible auger mounted to a sliding yoke in said housing;

(c) a first one of dual double acting hydraulic cylinder means mounted in a top portion of a channel in said housing to drive said sliding yoke, connected to said auger, with a second one of said dual double acting hydraulic cylinder means acting to drive said sliding yoke further downward after said first one of said dual double acting hydraulic cylinder means is fully extended and retracting to further pull said sliding yoke upward when said first one of said dual double acting hydraulic cylinder means is fully retracted;

(d) a locking bar means connected between a differential case of said tractor and a three point hitch means on said tractor to adjustably mount said mounting arms of said rigid channel shaped housing on said tractor and prevent movement of said three point hitch means;

(e) an extensible shaft means connected from a power take off of said tractor to a drive gear means to drive said auger.

2. A tractor mounted earth drill as in claim 1 wherein said drive gear means to drive said auger and said auger are both covered with a rigid safety shield.

3. A tractor mounted earth drill as in claim 1 wherein said rigid channel shaped housing and said mounting arms are of sufficient strength to allow putting a downward force through said hydraulic cylinders equivalent to full weight of a back portion of said tractor.

4. A tractor mounted earth drill as in claim 1 wherein said extensible auger comprises flights welded to a square cross-section outer shaft that is adjustably pinned to a closely fitting square cross-section inner shaft; said square cross-section inner shaft being driven by said power take off through said drive gear means.

5. A tractor mounted earth drill as in claim 1 wherein a hydraulic cylinder in a top linkage connected between a vertical arm of said mounting arms and a differential case of said tractor is operable to shorten to raise said rigid channel shape housing for transport and is operable to lengthen said top linkage to place downward pressure to hold said rigid channel shaped housing firmly against the ground.

6. A tractor mounted earth drill as in claim 1 wherein an automatic reset torque limiter cooperates with said drive gear means for said extensible auger to limit driving torque on said extensible auger.

7. A tractor mounted earth drill comprising:

(a) a housing means mountable to a tractor with said housing means having channel guides to allow vertical movement of an auger drive yoke and dual double acting hydraulic cylinder means to vertically lift and to vertically drive said auger drive yoke;

(b) an extensible square cross-section shaft for said auger mounted to said auger drive yoke and connected to a gear drive mechanism coupled with an automatic reset torque limiter, said automatic reset torque limiter being driven by an extensible drive shaft from said tractor;

(c) mounting arms connected to said housing means and mountable to a modified three point hitch means mountable to said tractor; said modified three point hitch means comprising an extensible locking arm connected between a differential case of said tractor and said mounting arms to prevent said modified three point hitch means from moving vertically and a hydraulic cylinder operator to allow effectively shortening and lengthening an upper member of said modified three point hitch means.

8. A tractor mounted earth drill as in claim 8 wherein an upper member in said mounting arms is a rigid shaft connecting to an upper end of said housing means.

* * * * *